US007669660B1

(12) United States Patent
Murray et al.

(10) Patent No.: US 7,669,660 B1
(45) Date of Patent: Mar. 2, 2010

(54) RISER DISCONNECT AND SUPPORT MECHANISM

(75) Inventors: John James Murray, Houston, TX (US); Harish Mukundan, Houston, TX (US); Apurva Gupta, Houston, TX (US)

(73) Assignee: Floatec, LLC, Houston, TX (US)

( * ) Notice: Subject to any disclaimer, the term of this patent is extended or adjusted under 35 U.S.C. 154(b) by 0 days.

(21) Appl. No.: 12/323,498

(22) Filed: Nov. 26, 2008

(51) Int. Cl.
*E21B 43/01* (2006.01)

(52) U.S. Cl. ..... 166/345; 166/339; 166/340; 166/344; 166/346; 166/352; 166/367

(58) Field of Classification Search ..... 166/345, 166/339–344, 346, 350–352, 367; 114/264; 441/3–5

See application file for complete search history.

(56) References Cited

U.S. PATENT DOCUMENTS 4,793,737 A * 12/1988 Shotbolt ..... 405/169
5,275,510 A * 1/1994 de Baan et al. ..... 405/171
5,755,607 A * 5/1998 Boatman et al. ..... 441/5
5,820,429 A * 10/1998 Smedal et al. ..... 441/5
5,941,746 A * 8/1999 Isnard et al. ..... 441/4
5,957,074 A * 9/1999 de Baan et al. ..... 114/230.12
6,206,742 B1 * 3/2001 Bull et al. ..... 441/1
6,213,215 B1 * 4/2001 Breivik et al. ..... 166/350
6,315,625 B1 * 11/2001 Braud ..... 441/5
6,595,725 B1 * 7/2003 Shotbolt ..... 405/224.2
6,857,822 B2 * 2/2005 Hooper et al. ..... 405/224.4
7,040,841 B2 * 5/2006 Kelm et al. ..... 405/224.2
7,197,999 B2 * 4/2007 Murray ..... 114/264
7,377,225 B2 * 5/2008 Finn et al. ..... 114/264
7,434,624 B2 * 10/2008 Wilson ..... 166/368
7,524,143 B2 * 4/2009 Loset et al. ..... 405/213
2008/0311804 A1 * 12/2008 Bauduin et al. ..... 441/23

* cited by examiner

*Primary Examiner*—Thomas A Beach
*Assistant Examiner*—Matthew R Buck
(74) *Attorney, Agent, or Firm*—D. Neil LaHaye; Eric Marich

(57) ABSTRACT

A riser disconnect and support mechanism for flexible risers and umbilicals on an offshore structure with low under keel clearance. A main body portion includes an inverted and truncated conical or convex section substantially at the center of the main body portion. The main body portion and conical section receive risers therethrough by means of a plurality of conduits through the main body portion and conical section. A plurality of projections extend radially outward from the main body portion. A plurality of arch-shaped riser supports are provided on each projection to support risers and/or umbilical lines and control their bending radii. The projections extend out from the main body portion at a distance that allows the portions of the risers below the main body portion to hang at an angle and bend radius in accordance with the design tolerances of the risers to prevent buckling or damage due to excessive bending while keeping the risers from contacting the sea floor.

7 Claims, 6 Drawing Sheets

RISER DISCONNECT AND SUPPORT MECHANISM

FIELD AND BACKGROUND OF INVENTION

The invention is related to the use of flexible production and water injection risers and control umbilicals with offshore structures and more particularly to a riser disconnect and support mechanism.

Floating offshore structures used in drilling for and production of hydrocarbons (natural gas and oil) use drilling and production risers that typically extend from the sea floor to the keel of the structure and then to the topside of floating structures.

A potential hazard in offshore operations is the escape of hydrocarbons and other products from the production risers and control umbilicals into enclosed locations in and around the facility structure. These hazards may be caused by damaged risers or failures in mechanical connectors in the flow lines inside the facility.

In some situations the riser arrangements may have to be disconnected from the supporting facility and this facility returned for reconnect at a later time. For example, offshore structure designs for deployment in arctic regions have to consider ice forces that can be the governing design load. Unlike bottom founded structures such as compliant towers and jackets and gravity base structures (GBS), floating structures are challenged by mooring and riser designs that make resistance to maximum expected ice loads impractical and thus require disconnection from the risers and moorings as part of the ice management scheme. Also the floating support hull may be returned to port for refitting or reconfiguration of the topsides.

Moored floating structures such as the ship-shaped Floating Production Unit (FPU), the Spar, and the Single Column Floater are practical designs for support facilities. Even in shallower water where earthquakes are a threat, the moored floater can be the better option because of its ability to avoid seismic effects of an earthquake on the structure since it is suspended in the water above the sea floor.

Several designs to disconnect and support riser arrangements from the floating support facilities presently exist.

The FPSO/PPS (Floating Production Storage and Offloading/Floating Production and Storage) generally has a weather-vaning mooring turret attached inboard at the keel. Risers and umbilicals pass through the turret up to the onboard production facilities. For disconnect between the risers and hull, the risers are disconnected at the turret and released to separate from the hull. After release the buoy is suspended in the water column with the aid of mooring lines and supports the risers. To reconnect, the buoy is recovered by the hull and pulled back into position. The risers are reconnected at the turret. The draft of the ship-shaped hull is generally in the order of 30 meters. At this draft it is practical to provide one atmosphere dry access to the assembly around the turret to make it accessible for inspection, maintenance, and repair.

Other designs based on deeper draft facilities such as the Spar and Single Column Floater have drafts in the order of 100 meters to 200 meters. These hull types offer the advantage of reduced motions, thus improving conditions for general operations and have a significant reduction in fatigue damage to the risers as compared to the shallower draft ship-shaped hulls. Spar based designs such as U.S. Pat. Nos. 7,377,225 and 7,197,999 describe disconnectable buoys at the keel similar to the FPSO/FPU with riser disconnect at the keel. The disadvantage of these designs is the depth of the disconnect buoy. Due to the in-situ pressure and space constraints inspection, maintenance, and repair are difficult and complicated. There is also risk that hazardous product escaping from the risers due to faulty connections at the buoy can collect inside the hull.

Floating offshore structures with relatively low clearance between the bottom of the structure and the sea floor also present special challenges for the connection and disconnection of risers at the bottom or sides of the structures. The flexible risers typically used with floating offshore structures have a minimum allowable bend radius beyond which will cause breakage of the riser. Also, the flexible risers must not touch the sea floor during connection to or disconnection from the structure and during the time that the risers are supported when not connected to a structure. These two challenges are not satisfactorily addressed in the current art.

SUMMARY OF INVENTION

The present invention is drawn to a mechanism for supporting risers during the connection and disconnection of risers to and from floating offshore structures with low under keel clearance. A main body portion includes a truncated inverted conical or convex section substantially at the center of the main body portion. Other convex shaped geometries can be used depending on the type of support vessel, for example, prismatic or pyramid shaped structures. The main body portion and conical section receives risers therethrough by means of a plurality of conduits through the main body portion and conical section. A plurality of projections extend radially outward from the main body portion. A plurality of arch-shaped riser supports are provided on each projection to support risers or umbilical lines. The projections extend out from the main body portion at a distance that allows the portions of the risers below the main body portion to hang at an angle and bend radius in accordance with the design tolerances of the risers to prevent buckling or damage due to excessive bending while keeping the risers from contacting the sea floor. The risers are continuous from the PLEM (Pipe Line End Manifold) on the sea floor to the production manifold connection on the production deck. The invention enables the support and handling of a continuous flexible riser between these two points of connection thus eliminating the risk of leakages due to connections in the riser or umbilical. The invention controls the bending stresses in the risers and umbilicals while in the connected and disconnected configurations.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
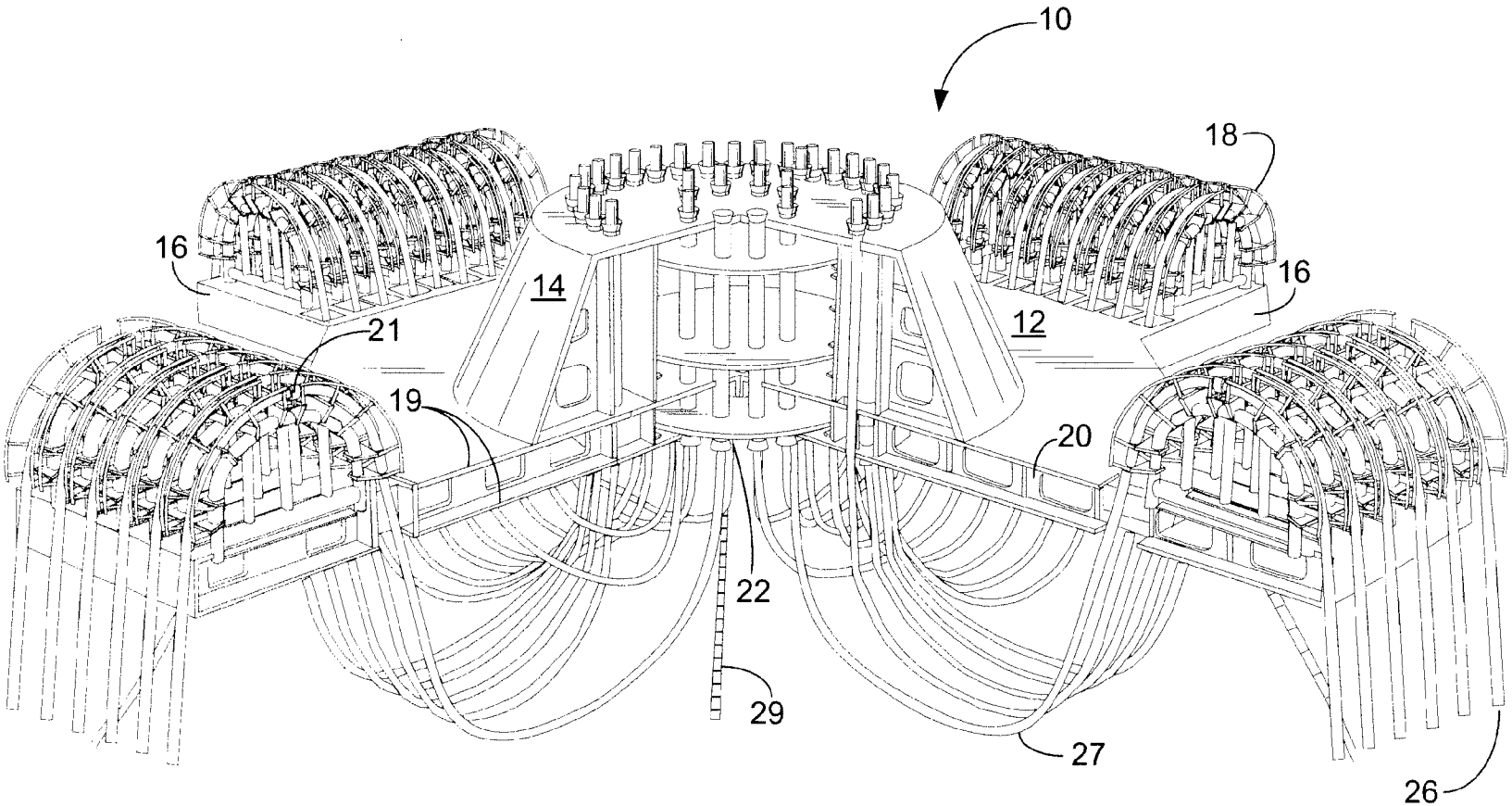
FIG. 1 is a perspective partial cutaway view of the invention.

The invention is generally indicated in FIG. 1 by numeral 10. The riser disconnect and support mechanism 10 (hereinafter referred to as riser support mechanism 10 for ease of reference) is generally comprised of a main body portion 12, a conical or convex section 14 on the main body portion 12, projections 16 on the main body portion 12, and support structure 18 on the projections 16.

The main body portion 12 includes conical section 14 and radial projections 16. As seen in FIG. 1 the main body portion 12 is illustrated as being formed of rigid plates 19 separated by bulkheads 20. The space between the plates may be used to receive a means for providing buoyancy to the riser support mechanism 10. The means for providing buoyancy may be by any suitable material typically used in the marine industry, such as dense foam or syntactic foam. The use of a relatively light buoyant material to provide buoyancy requires less steel in comparison to building water tight compartments and so helps to reduce the weight and cost of the structure. The main body portion 12 is sized in accordance with the floating offshore structure it is to be mated with and the required buoyancy is determined according to the size of the mechanism along with the weight of the risers and umbilical connections to be supported.

Figure 7:
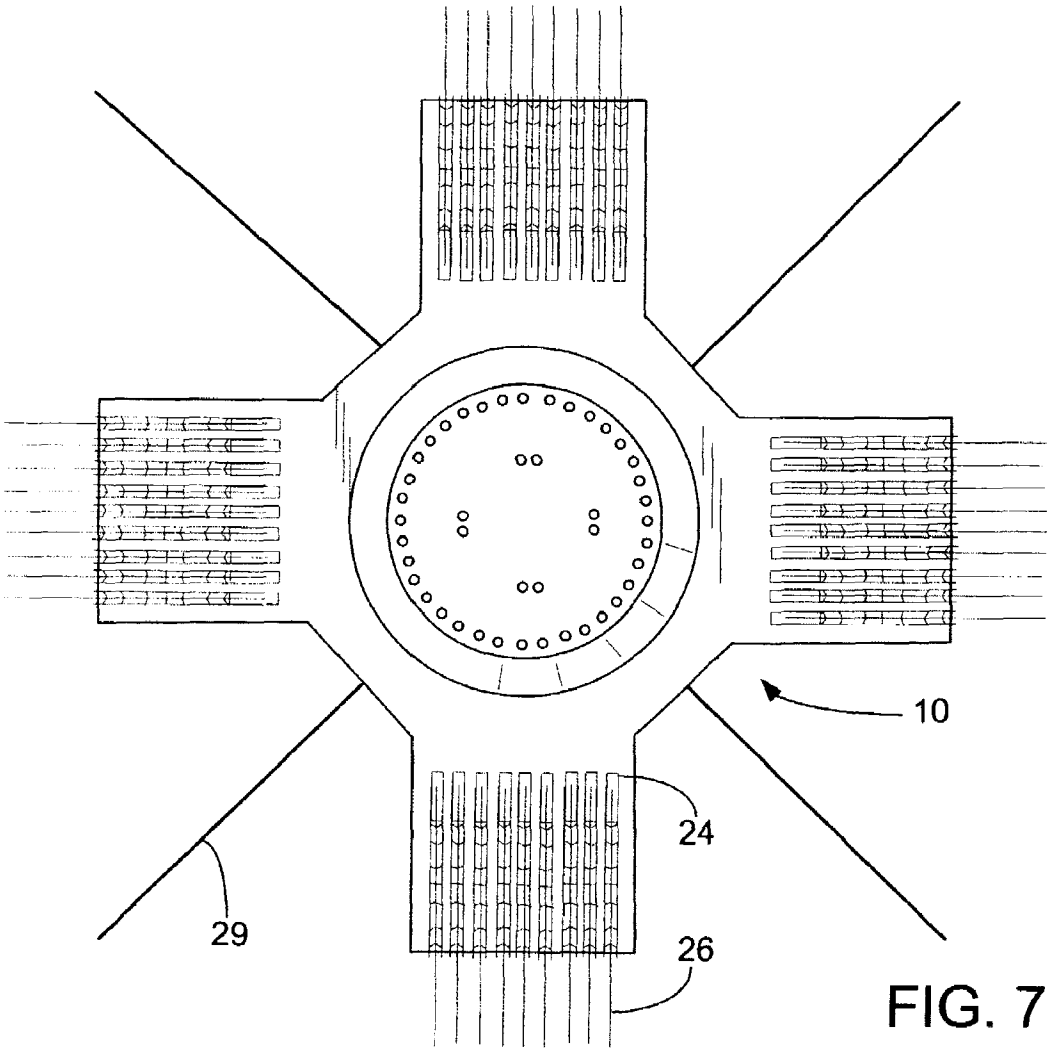
FIG. 7 is a plan view of the invention.

The conical section 14 extends up from the main body portion 12 essentially in an inverted partial cone shape and is supported by bulkheads. Conical section 14 is provided with a plurality of conduits 22 therethrough seen in FIGS. 1 and 4. The conduits 22 are sized to receive risers and umbilical lines used with the offshore floating structure. As seen in FIGS. 1 and 7 the conduits 22 are spaced inside the conical section 14. The specific arrangement depends on the total number of conduits and the minimum bend radius requirement of the flexible risers and umbilicals. The spacing distributes the risers and umbilical lines in a pattern to minimize unnecessary contact between the risers and umbilical lines and prevent damage thereto. While a conical section is shown for ease of illustration it should be understood that any other suitable convex shaped geometries may be used depending on the type of support vessel, for example, prismatic or pyramid shaped structures.

Projections 16 extend radially outward from the main body portion 12 and are illustrated as being formed of rigid plates separated by bulkheads in the same manner as main body portion 12. The number of projections 16 is determined by the number of risers to be used on the offshore structure and the field layout. Projections 16 may be integral with the main body portion 12 or separate structures that are rigidly attached to the main body portion 12.

While the main body portion 12, conical section 14, and projections 16 are illustrated as being formed of rigid plates supported by bulkheads, it should be understood that this is for illustration purposes only and that they may also be formed from a rigid open framework with the buoyancy means, such as foam, received in the open framework.

Support structures 18 are provided on the projections 16 to support risers and umbilical lines and control the bend radius to meet the requirements related to the properties of the risers and umbilical lines to prevent damage to the risers and umbilical lines. Support structures 18 are essentially an open framework that forms an arch shaped support surface for the risers and umbilical lines. The length of the hang off 27 increases when the riser and umbilicals are disconnected from the production manifold on the floating vessel. The support structures 18 are sized and shaped such that the risers and umbilicals 26 do not contact the sea floor when disconnected from the floating offshore structure 28. The support surface of each support structure 18 is equipped with a clamping mechanism 21 to restrain the riser or umbilical from relative motion between the riser/umbilical and the arch surface.

Passages 24 (best seen in FIG. 7) provided between the main body portion 12 and the projections 16 allow the risers and umbilical lines to be directed below the main body portion 12 as they come off the side of the support structures 18 that face the conical section 14.

In operation, the riser support mechanism 10 is positioned in the water and risers and umbilical lines 26 are installed on the riser support mechanism 10 such that the risers are supported by support structures 18, run through passages 24, and then through tubes 22. The upper end of each riser 26 that is to be connected to the production tree on the topside of the floating offshore structure 28 is held in position at the upper end of the conical section 14. The riser support mechanism 10 is held in place by mooring lines 29.

Figure 2:
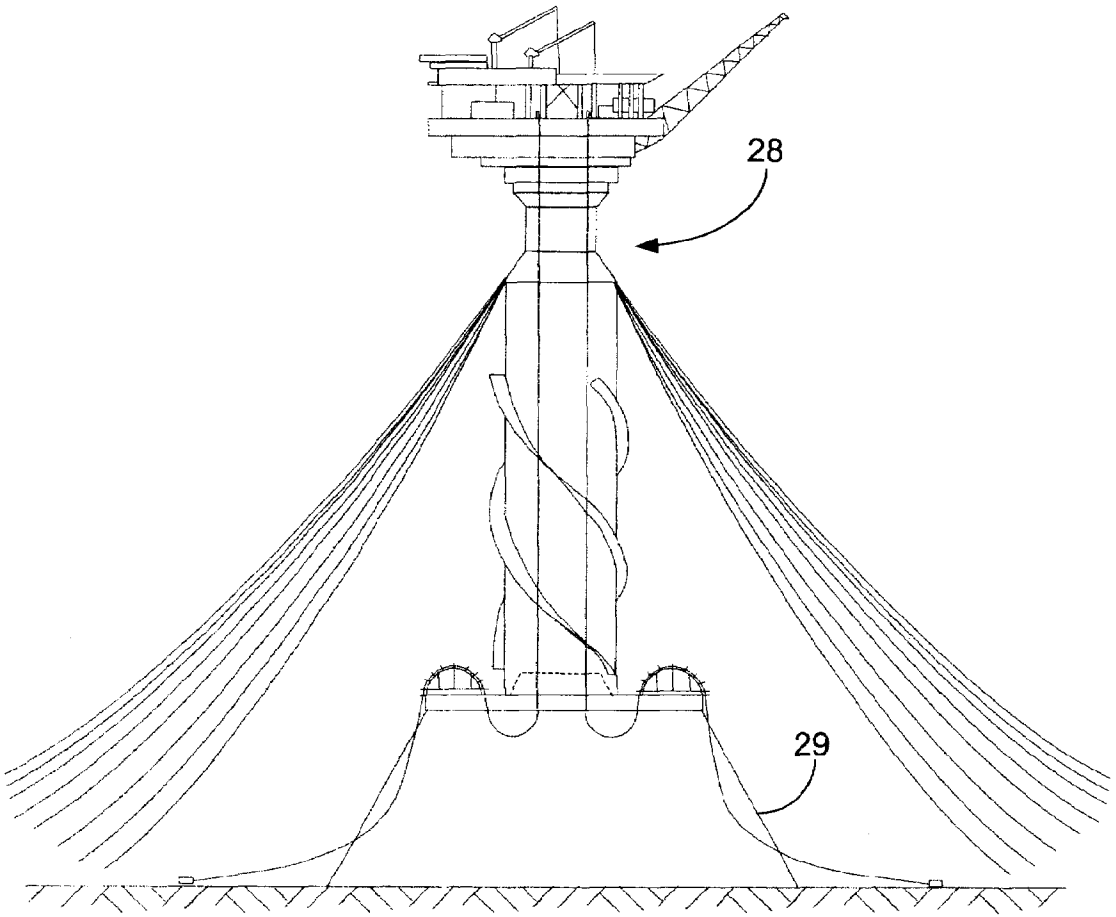
FIG. 2 is a side view of the invention connected to a Spar.
Figure 3:
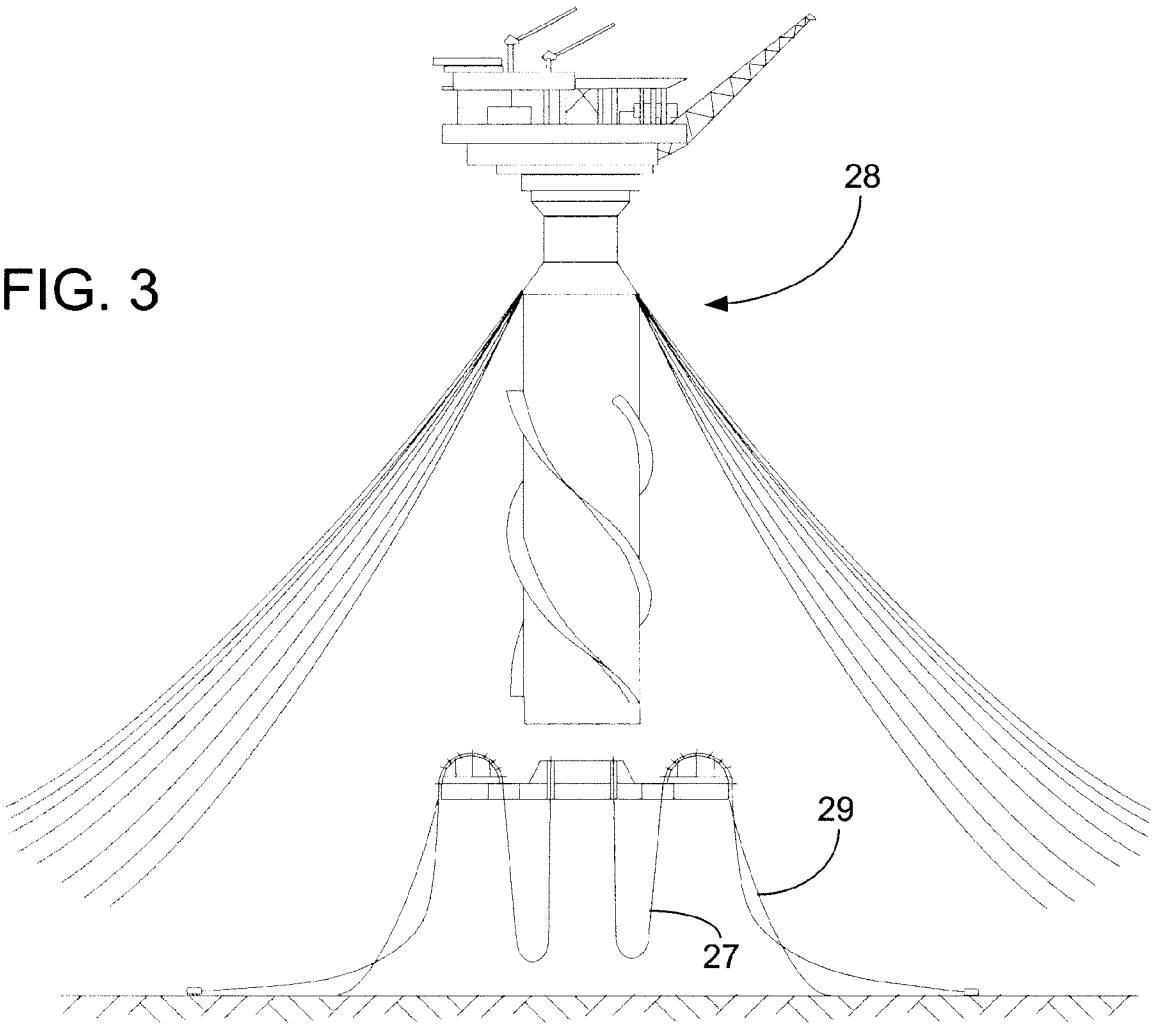
FIG. 3 is a side view of the invention disconnected from a Spar.
Figure 5:
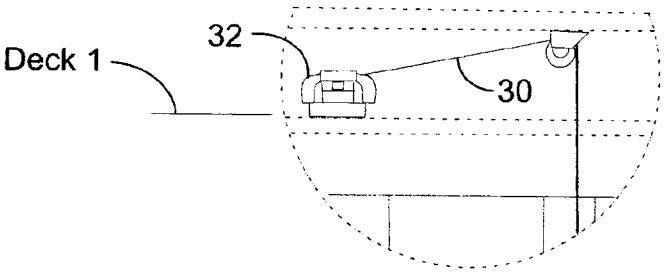
FIG. 5 is a detailed view of one area of the upper portion of a Spar.
Figure 4:
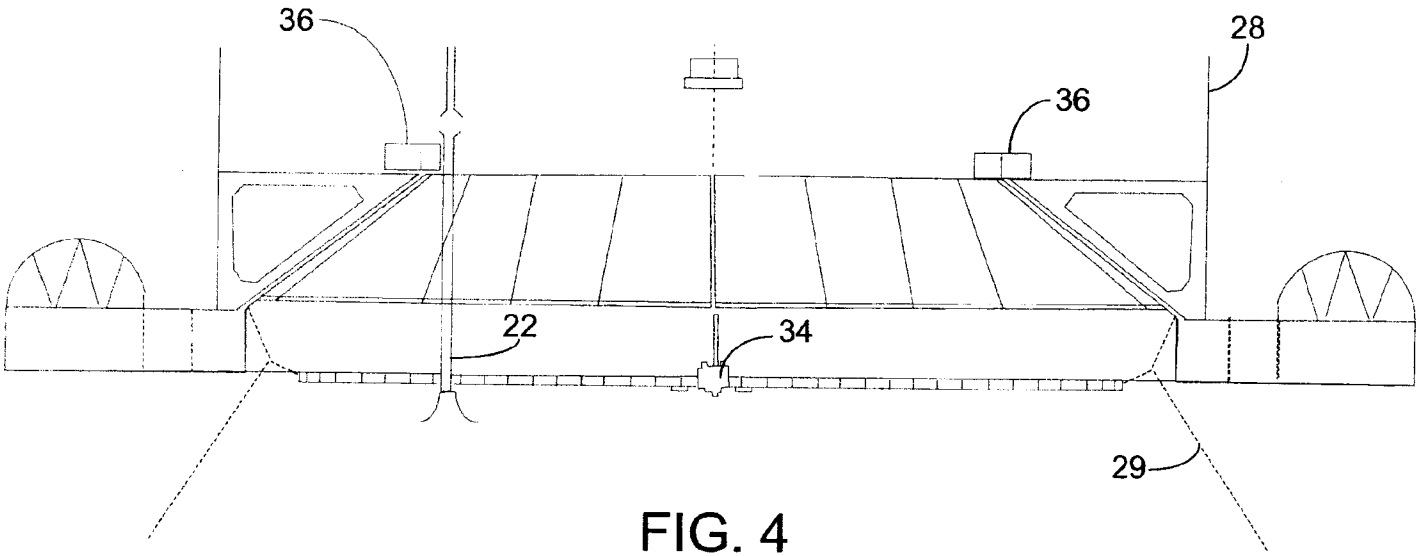
FIG. 4 is a side detail view of the invention in connection with a Spar.

The riser support mechanism 10 and floating offshore structure 28 are aligned as seen in FIG. 3. As illustrated in FIGS. 4 and 5, one or more lines 30 attached to a winch 32 on the floating offshore structure 28 and a connector 34 on the riser support mechanism 10 are used to pull the riser support mechanism 10 into contact with the floating offshore structure 28 as seen in FIG. 2. Locking mechanisms 36, schematically illustrated in FIG. 4, are used to lock the riser support mechanism 10 to the floating structure 28 to eliminate the need for constant tension on lines 30. The lines 30 can then be disconnected and pulled up using winch 32.

The risers 26 are then pulled up through the floating offshore structure 28 and connected to a production manifold not shown at the topside of the floating offshore structure 28. The opposite ends of the risers are connected to the well heads on the sea floor.

The riser support mechanism 10 and floating offshore structure 28 remain connected in this manner during production of oil and natural gas. When eminent conditions such as ice or a severe storm that would threaten the floating offshore structure and require it to be removed from the site, the riser support mechanism 10 allows disconnection of the risers 26 and movement of the floating offshore structure 28 without damage to the risers 26 and without the risers 26 touching the sea floor. This capability is especially important when the floating offshore structure 28 is positioned in waters that provide relatively low clearance between the bottom of the structure and the sea floor.

The risers 26 are disconnected from the production manifolds at the topside of the structure and the risers are sealed to prevent leakage of any product. The risers 26 are then lowered through the structure until the sealed upper end of each riser 26 is at the upper end of the conical section 14 on the riser support mechanism 10. The locking mechanisms 36 are then released and the riser support mechanism 10 sinks under its own weight a short distance to a position below the offshore structure 28 as seen in FIG. 3. The buoyancy of the riser support mechanism 10 prevents it from sinking to a point that would allow the risers 26 to touch the sea floor or bend to a point that exceeds the design capabilities of the risers. The risers 26 are then safely supported below the surface of the water and below the floating offshore structure such that the floating offshore structure can be moved to a safer area and returned as required to resume production.

Figure 6:
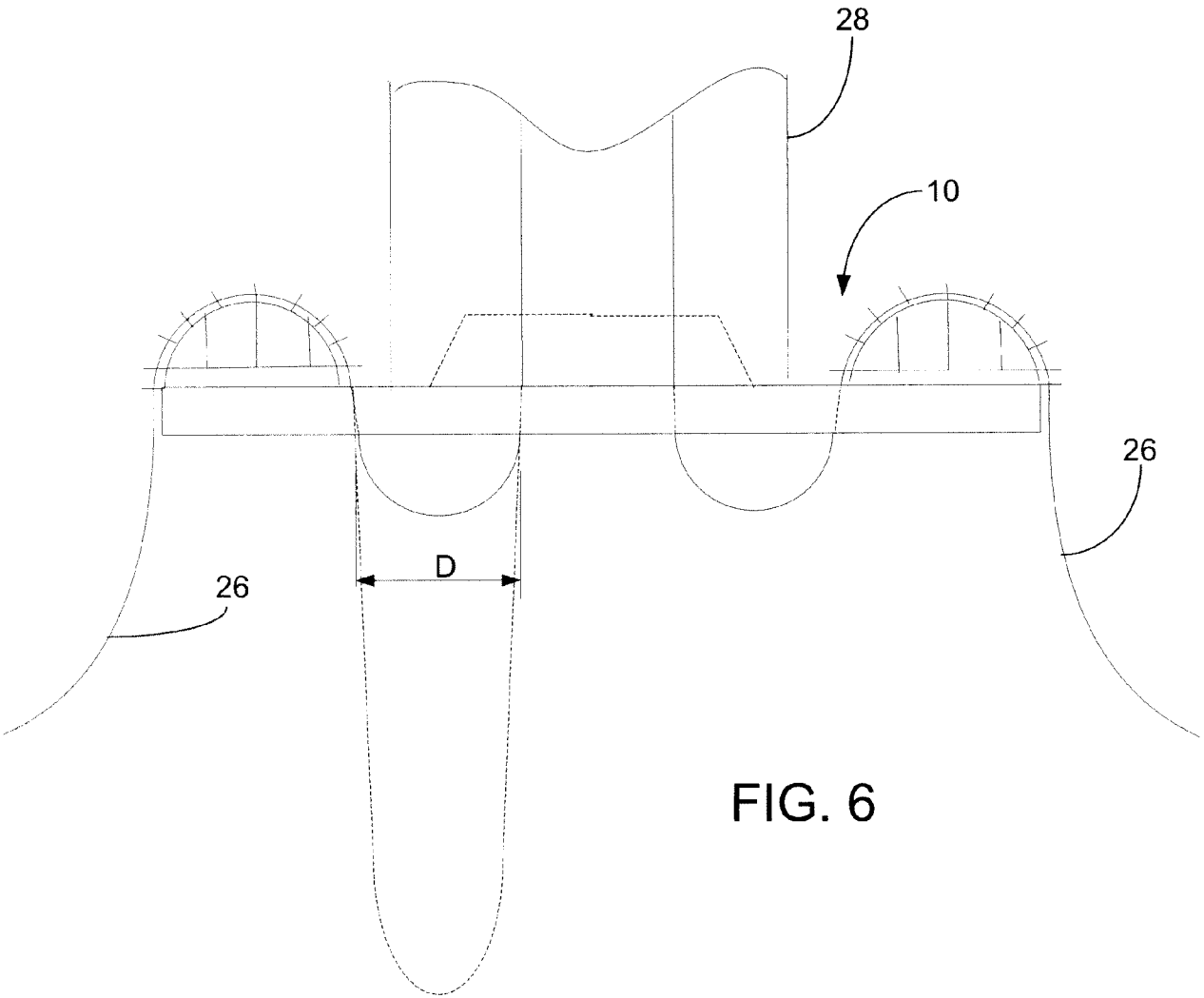
FIG. 6 is a schematic side view that illustrates the different positions of risers with the invention.

As best seen in FIG. 3 the length 27 of the risers 26 that would normally be in the floating offshore structure 28 during production drape below the riser support mechanism 10 at a level that protects the risers and prevents contact with the sea floor. As seen in FIG. 6 dimension D is set such that the bend radius of the risers does not exceed the allowable bend at which damage would occur to the risers. FIG. 6 also indicates the shape and drape of the riser 26 when it is installed in the floating offshore structure for production. Neither position exceeds the allowable bend radius of the risers. Thus the mechanism can accommodate the full length of the riser while disconnected.

A major difference of the invention from the prior state of the art is that the invention allows the use of risers that are connected directly to the production manifolds at the topside of the floating offshore structure. The prior state of the art required the use of risers that included a mechanical connector at the keel of the floating offshore structure because the prior state of the art lacked a riser support mechanism with the capability to prevent over bending of dry tree risers when disconnected from the floating offshore structure as well as preventing contact of the risers with the sea floor in water depths with relatively low clearance between the keel of the floating offshore structure and the sea floor.

While the drawings illustrate the use of the invention with a Spar type structure it should be understood that this is for ease of illustration and the invention may be used with any type of floating offshore structure such as a Spar, an FPSO/FPS, or a semi-submersible or any other floated design suitable for the operation.

In the type of use envisioned flexible risers are more typically used as opposed to steel catenary risers because steel catenary risers are generally unable to withstand the bending moments generated by floating offshore structures in these situations.

The invention provides several advantages over the prior art connect and disconnect mechanisms.

Combining the riser arch support structure and the buoyant main body portion and attaching them to the floating offshore structure eliminates the motion in the hanging section 27 and thus reduces fatigue damage in that hanging section.

Attaching the riser support and disconnect buoy to the floating offshore structure reduces the total length of the risers and umbilical lines that are required if they are supported by an external buoy used for the same purpose. Furthermore, attaching the buoy to the hull eliminates the possibility of a collision between the hull and buoy.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed is:

1. A disconnect and support mechanism for single segment continuous flexible risers and umbilicals between a subsea wellhead and production manifold above the water line on a floating offshore structure, comprising:

a. a rigid buoyant main body portion not in contact with the seabed during use;

b. a plurality of projections that are rigidly attached to and extend radially outward from said main body portion;

c. a convex section extending substantially from the center of said main body portion, said main body portion and convex section having conduits for receiving the risers and umbilicals therethrough and providing support after disconnecting the single segment continuous flexible risers and umbilicals; and d. a plurality of arch-shaped riser and umbilical supports on each of said projections, said supports being shaped and sized such that the risers and umbilicals are not over stressed from bending during installation or operation and the supported risers and umbilicals do not contact the sea floor when disconnected from the floating offshore structure.

2. The mechanism of claim 1, wherein there is a separate conduit for each riser and umbilical with each conduit extending through the main body portion and convex section.

3. The mechanism of claim 1, wherein said main body portion is formed of rigid plates.

4. The mechanism of claim 1, wherein risers and umbilicals supported on said support mechanism are directed through the convex section and main body portion, through passageways between the main body portion and the projections, and over the arch-shaped supports on the projections.

5. A disconnect and support mechanism for single segment continuous flexible risers and/or umbilicals between a subsea wellhead and production manifold above the water line on a floating offshore structure, comprising:

a. a rigid buoyant main body portion not in contact with the seabed during use;

b. a plurality of projections that are rigidly attached to and extend radially outward from said main body portion;

c. a convex section extending substantially from the center of said main body portion, said main body portion and convex section having a plurality of conduits for receiving a plurality of risers and umbilicals therethrough and providing support after disconnecting the single segment continuous flexible risers and umbilicals;

d. a plurality of arch-shaped riser and umbilical supports on each of said projections, said supports being shaped and sized such that the supported risers and umbilicals are not over stressed from bending during installation or operation and the supported risers and umbilicals do not contact the sea floor when disconnected from the floating offshore structure; and e. means on said main body portion for providing buoyancy to said disconnect and support mechanism.

6. The mechanism of claim 5, wherein risers and umbilicals supported on said support mechanism are directed through the convex section and main body portion, through passageways between the main body portion and the projections, and over the arch-shaped supports on the projections.

7. A disconnect and support mechanism for single segment continuous flexible risers and/or umbilicals between a subsea wellhead and production manifold above the water line on a floating offshore structure, comprising:

a. a rigid buoyant main body portion not in contact with the seabed during use;

b. a plurality of projections that extend radially outward from said main body portion;

c. a convex section extending substantially from the center of said main body portion, said main body portion and convex section having a plurality of conduits for receiving a plurality of risers and umbilicals therethrough and providing support after disconnecting the single segment continuous flexible risers and umbilicals;

d. a plurality of arch-shaped riser and umbilical supports on each of said projections, said supports being shaped and sized such that the risers and umbilicals are not over stressed from bending during installation or operation and the supported risers and umbilicals do not contact the sea floor when disconnected from the floating off-shore structure;

e. means on said main body portion for providing buoyancy to said riser disconnect and support mechanism; and f. a clamping mechanism on each of arch-shaped riser and umbilical supports for holding the riser and umbilical in position thereon.

* * * * *